US007332464B2

(12) United States Patent
Cramer et al.

(10) Patent No.: US 7,332,464 B2
(45) Date of Patent: Feb. 19, 2008

(54) PROCESS FOR PREPARING BLEACH ACTIVATOR COGRANULATES

(75) Inventors: Jürgen Cramer, Eppstein (DE); Johannes Himmrich, Eppstein (DE); Helmut Kramer, Mainz (DE)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 0 days.

(21) Appl. No.: 11/481,469

(22) Filed: Jul. 6, 2006

(65) Prior Publication Data

US 2006/0252664 A1 Nov. 9, 2006

Related U.S. Application Data

(63) Continuation of application No. 10/318,805, filed on Dec. 13, 2002, now abandoned.

(30) Foreign Application Priority Data

Dec. 15, 2001 (DE) ..... 101 61 766

(51) Int. Cl.

| | |
|---|---|
| ***C11D 7/32*** | (2006.01) |
| ***C11D 7/08*** | (2006.01) |
| ***C11D 7/22*** | (2006.01) |
| ***C11D 7/54*** | (2006.01) |

(52) U.S. Cl. ..... 510/314; 510/376; 510/445; 510/499; 510/500; 510/505

(58) Field of Classification Search ..... None
See application file for complete search history.

(56) References Cited

U.S. PATENT DOCUMENTS

| | | | |
|---|---|---|---|
| 3,588,715 A | 6/1971 | Smeets | |
| 3,822,114 A | 7/1974 | Montgomery | |
| 3,929,678 A | 12/1975 | Laughlin | |
| 4,915,863 A | 4/1990 | Aoyagi | |
| 5,041,232 A | 8/1991 | Batal | |
| 5,047,163 A | 9/1991 | Batal | |
| 5,236,616 A | 8/1993 | Oakes | |
| 5,244,594 A | 9/1993 | Favre | |
| 5,246,621 A | 9/1993 | Favre | |
| 5,281,361 A | 1/1994 | Adams | |
| 5,739,327 A | 4/1998 | Arbogast | |
| 5,741,437 A | 4/1998 | Arbogast | |
| 6,063,750 A | 5/2000 | Loffler | |
| 6,107,266 A | 8/2000 | Himmrich | |
| 6,133,216 A | 10/2000 | Loffler | |
| 6,211,130 B1 | 4/2001 | Josa Pons | |
| 6,214,785 B1 * | 4/2001 | Himmrich et al. | 510/444 |
| 6,593,473 B1 | 7/2003 | Schoenherr | |
| 6,645,927 B1 | 11/2003 | Himmrich | |
| 2001/0046951 A1 | 11/2001 | Ogura et al. | |
| 2002/0032139 A1 | 3/2002 | Nitsch | |
| 2003/0166484 A1 | 9/2003 | Kingman | |

FOREIGN PATENT DOCUMENTS

| | | |
|---|---|---|
| EP | 0 790 244 | 8/1997 |

OTHER PUBLICATIONS

English Language Abstract of EP 0 790 244, Aug. 20, 1997.
W. Stein, et al., "Alpha-Sulfonated Fatty Acid and Esters: Manufacturing Process, Properties, and Applications", J. Amer. Oil Chemists Soc., 52, 1975, pp. 323-329.
EPO Search Report Issued in Connection with EP 02 02 7051, Apr. 3, 2003.

* cited by examiner

*Primary Examiner*—Gregory R. Del Cotto
(74) *Attorney, Agent, or Firm*—Richard P. Silverman

(57) ABSTRACT

Bleach activator cogranulates of one or more ammonium nitrites and at least one further bleach activator obtained by spraying an aqueous solution of one or more ammonium nitrites onto the further bleach activator, granulating the resulting mixture and drying and sieving the moist granulate.

14 Claims, No Drawings

PROCESS FOR PREPARING BLEACH ACTIVATOR COGRANULATES

CROSS-REFERENCE TO RELATED APPLICATIONS

This application is a continuation of application Ser. No. 10/318,805, filed Dec. 13, 2002, now abandoned which is hereby incorporated by reference.

BACKGROUND OF THE INVENTION

The invention relates to bleach activator cogranulates of one or more ammonium nitriles and at least one further bleach activator which react in a broad temperature range from 10° C. to 70° C. with a bleach and induce a bleaching action. In addition, the granulates according to the invention are characterized by improved storage stability, and also by high active ingredient contents.

Bleach activators are important constituents in compact detergents, stain-removal salts and machine dishwashing detergents. At 40° C. to 60° C., conventional bleach activators permit a bleaching result comparable with that of a boil wash by reacting with hydrogen peroxide donors (in most cases perborates, percarbonates, persilicates and perphosphates) with release of an organic peroxicarboxylic acid.

The bleaching result which can be achieved is determined by the nature and reactivity of the peroxicarboxylic acid formed, the structure of the bond to be perhydrolyzed and the solubility in water of the bleach activator. Many substances are known as bleach activators in the prior art. These are usually reactive organic compounds with an O-acyl or N-acyl group which, even in the washing powder mixture, favored by the residual moisture present, can react with the bleach, such as, for example, sodium perborate, if the two components are present in unprotected form.

Representative examples of bleach activators are N,N,N',N'-tetraacetylethylenediamine (TAED), nonanoylcaprolactam phenylsulfonate ester (APES), glucose pentaacetate (GPA), xylose tetraacetate (TAX), acyloxybenzenesulfonates (e.g. nonanoyloxybenzenesulfonate (NOBS), sodium 4-benzoyloxybenzenesulfonate (SBOBS), sodium trimethylhexanoyloxybenzenesulfonate (STHOBS), diacetyldioxohexahydrotriazine (DADHT), tetraacetylglucoluril (TAGU), tetraacetylcyanic acid (TACA), di-N-acetyidimethylglyoxine (ADMG) and 1-phenyl-3-acetylhydantoin (PAH) and nitrilotriacetate (NTA). These bleach activators have the greatest degree of effectiveness in the temperature range from 40° C. to 60° C.

Ammonium nitriles ("nitrile quats") form a particular class of cationic bleach activators. Compounds of this type and the use thereof as bleach activators in bleaches are described in EP-A-0 303 520, EP-A-0 464 880, EP-A-0 458 396, EP-A-0 897 974 and EP-A-0 790 244.

BRIEF SUMMARY OF THE INVENTION

The invention provides cogranulates of one or more ammonium nitrites and at least one further bleach activator, where these cogranulates are obtained by spraying an aqueous solution of one or more ammonium nitrile(s) onto the further bleach activator(s), granulating the resulting mixture and drying and sieving the moist granulates.

DETAILED DESCRIPTION OF THE INVENTION

Suitable ammonium nitrites are in particular compounds of the formula (1)

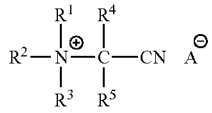

(1)

in which $R^1$, $R^2$, $R^3$ are identical or different, and are linear or branched $C_1$-$C_{24}$-alkyl groups, $C_2$-$C_{24}$-alkenyl groups or are $C_1$-$C_4$-alkoxy-$C_1$-$C_4$-alkyl groups, substituted or unsubstituted benzyl, or in which $R^1$ and $R^2$ together with the nitrogen atom to which they are bonded form a ring having 4 to 6 carbon atoms which may be substituted by $C_1$-$C_5$-alkyl, $C_1$-$C_5$-alkoxy, $C_1$-to $C_5$-alkanoyl, phenyl, amino, ammonium, cyano, cyanamino, chlorine or bromine, and, in addition to the nitrogen atom, can contain one or two oxygen or nitrogen atoms, a group N—$R^6$ or a group $R^3$—N—$R^6$ in place of carbon atoms, in which $R^6$ is hydrogen, $C_1$- to $C_5$-alkyl, $C_2$- to $C_5$-alkenyl, $C_2$- to $C_5$-alkynyl, phenyl, $C_7$- to $C_9$-arylalkyl, $C_5$- to $C_7$-cycloalkyl, $C_1$- to $C_6$-alkanoyl, cyanomethyl or cyano, $R^4$ and $R^5$ are hydrogen, $C_1$-$C_4$-alkyl, $C_1$-$C_4$-alkenyl, $C_1$-$C_4$-alkoxy-$C_1$-$C_4$-alkyl, phenyl or $C_1$-$C_3$-alkylphenyl, preferably hydrogen, methyl or phenyl, where in particular $R^4$ is hydrogen, if $R^5$ is not a hydrogen, and A is an anion, for example chloride, bromide, iodide, fluoride, sulfate, hydrogensulfate, carbonate, hydrogencarbonate, phosphate, mono- and dihydrogenphosphate, pyrophosphate, metaphosphate, nitrate, methylsulfate, phosphonate, methylphosphonate, methanedisulfonate, methylsulfonate, ethanesulfonate or is an anion of the formulae $R^7SO_3^{\circ}$, $R^7SO_4^{\circ}$ or $R^7COO^{\circ}$, in which $R^7$ is $C_1$-$C_{20}$-, preferably $C_{10}$-$C_{18}$-alkyl, and additionally also $C_1$-$C_{18}$-alkylphenyl. Particularly preferred anions are cumenesulfonate and $C_{12/18}$-alcohol sulfate.

As ammonium nitriles, particular preference is given to compounds of the formula 2

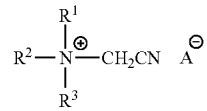

(2)

where $R^1$, $R^2$ and $R^3$ are a linear or branched saturated or unsaturated alkyl group having 1 to 24 carbon atoms, an alkenyl group having 2 to 24 carbon atoms or substituted or unsubstituted benzyl, and A is any charge-balancing ion, for example chloride, bromide, iodide, fluoride, sulfate, hydrogensulfate, carbonate, hydrogencarbonate, phosphate, mono- and dihydrogenphosphate, pyrophosphate, metaphosphate, nitrate, methylsulfate, phosphonate, methylphosphonate, methanedisulfonate, methylsulfonate, ethanesulfonate or is an anion of the formulae $R^7SO_3^{\circ}$, $R^7SO_4^{\circ}$ or $R^7COO^{\circ}$, where $R^7$ has the meanings given above. Particularly preferred anions are cumenesulfonate and $C_{12/18}$-alcohol sulfate.

Particular preference is given to use of compounds according to formula 2 in which $R^1$, $R^2$ and $R^3$ are each a methyl group. The charge-balancing anion can be any anion as desired, preferably chloride or methosulfate or a mixture of different anions, for example chloride or methosulfate and cumenesulfonate and/or laurylsulfate and/or fatty acid alkyl carboxylates.

Ammonium nitriles according to formula 1 and 2 are characterized by a particularly good bleaching power in the presence of a bleach at low temperatures in the range from 10° C. to 50° C.

For the use of the ammonium nitriles as bleach activator in laundry detergents and cleaners, however, their hygroscopicity and sensitivity to hydrolysis in the presence of alkaline laundry detergent constituents and a correspondingly low storage stability associated therewith are highly disadvantageous.

According to EP-A-0 464 880, an improvement in the storage stability of ammonium nitriles can be achieved by preparing ammonium nitriles with alkane- or paraffinsulfonate, arylsulfonate, primary alcohol sulfate, or fatty acid alkylcarboxylate as counterion by means of anion exchange by precipitation reaction in polar organic solvents, such as, for example, methanol and isopropanol.

The anion exchange is disadvantageous for ecological and economical reasons; removal of the solvent from the precipitation product is complex.

Another way of preventing hydrolysis of the bleach activators in the presence of alkaline laundry detergent constituents and of ensuring adequate storage stability is to granulate and coat the bleach activators prior to their use in laundry detergent and cleaner preparations.

WO 98/23531, WO 00/58273 and WO 00/36061 describe that acetonitrile derivatives, in particular cyclic acetonitrile compounds, are converted into a solid form for incorporation into solid laundry detergents and cleaners by stirring a carrier material having the largest possible surface area, for example silica, into an aqueous acetonitrile solution, or by spraying or mixing the aqueous solution onto the carrier, and subjecting the resulting mixture to drying under reduced pressure at elevated temperatures. The granulates or particles described in the specifications have water contents of up to 20 percent by weight, preferably less than 1 percent by weight. An unsatisfactory aspect is the hygroscopicity and, consequently, the storage stability of the products, in particular of the linear acetonitrile derivatives at fluctuating atmospheric humidity, and a partial decomposition of the hydrolysis-sensitive acetonitrile compounds during the thermal drying process.

EP 1 122 300 describes bleaches which comprise, as bleach activator, an ammonium nitrile, optionally in the mixture with further bleach activators, for example alkanoyloxybenzenesulfonic acid or tetraacetylethylenediamine, and also an inorganic peroxide and an alkali metal carbonate. The specification does not teach how the hydrolysis sensitivity of the ammonium nitrites can be minimized.

All of the methods described hitherto for formulating ammonium nitrites do not satisfy the requirements for compositions with a good bleaching action over a broad temperature range, and high storage stability of solid particles with high active ingredient contents in a satisfactory manner.

The further bleach activators used according to the invention are solid and naturally have a structure different to that of the ammonium nitrites. Suitable for this purpose are N,N,N',N'-tetraacetylethylenediamine (TAED), nonanoylcaprolactam phenylsulfonate ester (APES), glucose pentaacetate (GPA), xylose tetraacetate (TAX), acyloxybenzenesulfonates, (e.g. nonanoyloxybenzenesulfonate (NOBS), sodium 4-benzoyloxybenzenesulfonate (SBOBS), sodium trimethylhexanoyloxybenzenesulfonat (STHOBS), diacetyldioxohexahydrotriazine (DADHT), tetraacetylglucoluril (TAGU), tetraacetylcyanic acid (TACA), di-N-acetyldimethylglyoxine (ADMG) and 1-phenyl-3-acetylhydantoin (PAH) or nitrilotriacetate (NTA). Preference is given to TAED.

The cogranulates according to the invention are prepared by spraying the further bleach activator(s) with an aqueous solution of one or more ammonium nitrile(s) and granulating this mixture.

The water content of the granulates obtained in this way is then reduced to less than 5% by weight, preferably less than 2% by weight. Removal of the excess water can be carried out by drying with the introduction of heat, where the temperature of the granulate expediently does not exceed 100° C. and is below the melting temperature of the granulate. Suitable dryers are those which do not adversely change the granulate structure of the product, for example tray dryers, vacuum dryers or fluidized-bed dryers.

The coarse fraction and the fine fraction are separated off from the dried granulate by sieving. The coarse fraction is comminuted by grinding and, like the fine fraction, is passed to another granulation process.

The particle size of the granulate prepared in this way is generally in the range 100 μm-2000 μm, preferably 300 μm-1800 μm, particularly preferably 600 μm-1200 μm. The bulk density is in the range from 400 to 700 kg/m$^3$.

An increase in the bulk density can be achieved by compressing the granulates to give relatively large agglomerates, for example in roll compactors, and then comminuting them using mills, toothed-disc rollers and/or sieves.

The total amount of all bleach activators, based on the finished dry cogranulate, is 50% by weight to 99% by weight, preferably 70% by weight to 98% by weight, in particular 80% by weight to 96% by weight.

The weight fraction of ammonium nitrile, based on the finished dry cogranulate, is 1% by weight to 50% by weight, preferably 10% by weight to 40% by weight, particularly preferably 15% by weight to 35% by weight.

In a preferred embodiment, the cogranulate according to the invention additionally comprises binders and acidic additives which reduce the sensitivity to hydrolysis of the ammonium nitrile.

Suitable binders are cellulose and starch, and ethers or esters thereof, for example carboxymethylcellulose (CMC), methylcellulose (MC) or hydroxyethylcellulose (HEC) and the corresponding starch derivatives, but also film-forming polymers, for example polyacrylic acids and copolymers of maleic anhydride and acrylic acid, and the salts of these polymer acids. Commercially available products are, for example, Sokalan® CP 5 or 45.

Also suitable are pulverulent anionic components, in particular alkanesulfonates, alkylarylsulfonates, arylsulfonates, in particular cumene-, xylene-, toluenesulfonate, alkyl ether sulfates, alkylsulfates, α-olefinsulfonates and soaps.

The amount of binders, based on the finished granulate., may be 1 to 45% by weight, preferably 5 to 15% by weight.

Suitable acidic additives are sulfuric acid, sodium hydrogen sulfate, phosphoric acid, sodium hydrogenphosphate, phosphonic acids and salts thereof, carboxylic acids or salts thereof, such as citric acid in anhydrous or hydrated form, glycolic acid, succinic acid, succinic anhydride, glutaric acid, glutaric anhydride, adipic acid, adipic anhydride, maleic acid, maleic anhydride or lactic acid, but also acidic polymers.

Particularly suitable polymers are polyacrylic acid, polymaleic acid or copolymers of acrylic acid and maleic acid.

The amount of acidic additive and concentration thereof is such that the proportion of the acidic additive in the finished granulate is approximately 0 to 20% by weight, preferably 1 to 15% by weight, in particular 1 to 10% by weight.

In cases where the cogranulate according to the invention comprises binders and/or acidic additives, the procedure may involve firstly premixing these components together with the further bleach activator(s).

This step can be carried out in customary batchwise or continuously operating mixing devices, which are generally equipped with rotating mixing elements, for example in a plowshare mixer. Depending on the effectiveness of the mixing device, the mixing times for a homogeneous mixture are generally between 30 seconds and 5 minutes.

This mixture is then moistened with an aqueous solution of one or more ammonium nitrites at temperatures of from about 20 to 80° C. Granulation, drying and sieving are then carried out, as stated above.

According to a second variant, the procedure may also involve adding binders and/or acidic additives to the aqueous solution of the ammonium nitrile(s) and spraying the aqueous solution onto the further bleach activator(s). It is of course also possible to premix the binder(s) with the further bleach activator(s) and spray with the solution of the ammonium nitrile(s) which comprises acidic additives, or vice versa, by premixing the further bleach activator(s) with the acidic additives and spraying the binder(s) within the aqueous solution of the ammonium nitrile(s). In all variants, the aqueous solution of the ammonium nitrile(s) can also comprise anionic components, in particular alkanesulfonates, alkylarylsulfonates, arylsulfonates, in particular cumene-, xylene-, toluenesulfonate, alkyl ether sulfates, alkylsulfates, α-olefinsulfonates and soaps in parts by weight of from 0 to 3, preferably 0.5 to 2, particularly preferably 1 to 2, based on the ammonium nitrile present in the cogranulate.

The preparation can also be carried out by mixing all of the components in the dry state and then granulating the mixture with the addition of water. In a further variant, a mixture of dry components can be blended with one or more water-moist solid(s) and granulated.

In a preferred embodiment, the resulting cogranulates themselves, but in particular the fine fraction which is produced, and the coarse fraction ground to a powder can be used as carrier material onto which aqueous nitrile quat solution is metered again with intensive thorough mixing. This operation can be repeated as desired within the scope of the physicochemical properties of the resulting cogranulates.

The cogranules obtained according to the invention are suitable directly for use in laundry detergents and cleaners. In a particularly preferred use form, however, they may be provided with a coating by methods known per se. For this, the cogranulate is coated in an additional step with a film-forming substance, which may considerably influence the product properties.

Suitable coating agents are all film-forming substances, such as waxes, silicones, fatty acids, fatty alcohols, soaps, anionic surfactants, nonionic surfactants, cationic surfactants, anionic and cationic polymers, polyethylene glycols, and polyalkylene glycols.

Preference is given to using coating substances with a melting point of 30-100° C. Examples thereof and a process for applying them are described in EP-A-0 835 926. The coating materials are usually applied by spraying the molten or solvent-dissolved coating materials. The coating material can be applied to the granulate core according to the invention in amounts of from 0 to 30% by weight, preferably from 5 to 15% by weight, based on the total weight.

The use of these coating materials can further improve the storage stability and hygroscopicity and can influence the reaction kinetics in a targeted manner in order, in this way, to suppress interactions between the bleach activator and the enzyme system at the start of the washing process.

Moreover, the cogranulates according to the invention can also comprise further suitable additives, such as anionic and nonionic surfactants, which contribute to more rapid dissolution of the cogranulates according to the invention, and bleach stabilizers, such as, for example, phosphonates and polyphosphonates. Preferred anionic surfactants are alkali metal salts, ammonium salts, amine salts and salts of amino alcohols of the following compounds: alkyl ether sulfates, alkylamide sulfates and ether sulfates, alkylaryl polyether sulfates, monoglyceride sulfates, alkylamide sulfonates, alkyl sulfosuccinates, alkyl ether sulfosuccinates, alkylamide sulfosuccinates, alkyl sulfoacetates, alkylpolyglycerol carboxylates, alkyl phosphates, alkyl ether phosphates, alkyl sarcosinates, alkyl polypeptidates, alkyl amidopolypeptidates, alkyl isethionates, alkyl taurates, alkylpolyglycol ether carboxylic acids or fatty acids, such as oleic acid, ricinoleic acid, palmitic acid, stearic acid, copra oil acid salt or hydrogenated copra oil acid salts. The alkyl radical of all of these compounds normally contains 8-32, preferably 8-22, carbon atoms.

Preferred nonionic surfactants are polyethoxylated, polypropoxylated or polyglycerolated ethers of fatty alcohols, polyethoxylated, polypropoxylated and polyglycerolated fatty acid esters, polyethoxylated esters of fatty acids and of sorbitol, polyethoxylated or polyglycerolated fatty amides.

Likewise suitable additives are complexing agents and transition metal complexes, e.g. iron-, cobalt- or manganese-containing metal complexes, as described in EP-A-0 458 397 and EP-A-0 458 398.

Further possible additives are substances which, in the wash liquor, react with the peroxycarboxylic acid liberated from the activator to form reactive intermediates, such as dioxiranes or oxaziridines, and in this way can increase the reactivity. Corresponding compounds are ketones and sulfonimines corresponding to U.S. Pat. No. 3,822,114 and EP-A-0 446 982.

The amount of the additive is governed in particular by its nature. For example, acidifying additives and organic activators for increasing the performance of the peracid are added in amounts of from 0 to 20% by weight, in particular in amounts of from 1 to 10% by weight, based on the total weight, whereas metal complexes are added in concentrations in the ppm range.

The cogranulates according to the invention are characterized by very good storage stability in pulverulent laundry detergents, cleaners and disinfectant formulations. They are ideal for use in heavy-duty detergents, stain-removal salts, machine dishwashing detergents, pulverulent all-purpose cleaners and denture cleansers.

In these formulations, the cogranulates according to the invention are used in combination with a source of hydrogen peroxide. Examples thereof are perborate monohydrate, perborate tetrahydrate, percarbonates, alkali metal persulfates, persilicates and percitrates, where sodium is the preferred alkali metal, and hydrogen peroxide adducts onto urea or amine oxides. In addition or alternatively, peroxycarboxylic acids, for example dodecanediperacid or phthalimidopercarboxylic acids, which may optionally be substituted on the aromatic, may be present. The addition of small amounts of known bleach stabilizers, such as, for example, of phosphonates, borates, or metaborates and metasilicates, and magnesium salts such as magnesium sulfate, may be advantageous.

In addition, the formulation can have further laundry detergent constituents corresponding to the prior art, such as nonionic, anionic, cationic or amphoteric surfactants, organic and inorganic builders and cobuilders, enzymes, bleach activators, bleach catalysts, salts, optical brighteners, antiredeposition agents, foam inhibitors, sequesterants and fragrances and dyes.

Preferred nonionic surfactants are fafty alcohol ethoxylates having about 1 to about 25 mol of ethylene oxide. The alkyl chain of the aliphatic alcohols may be linear or branched, primary or secondary, and generally contains 8 to 22 carbon atoms. Particular preference is given to the condensation products of alcohols which contain an alkyl chain of 10 to 20 carbon atoms, with 2 to 18 mol of ethylene oxide per mole of alcohol. The alkyl chain may be saturated or else unsaturated. The alcohol ethoxylates may likewise have a narrow homolog distribution of the ethylene oxide (narrow range ethoxylates) or a broad homolog distribution of the ethylene oxide (broad range ethoxylates). Examples of commercially available nonionic surfactants of this type are Tergitol™ 15-S-9 (condensation product of a C11-C15-linear secondary alcohol with 9 mol of ethylene oxide), Tergitol™ 24-L-NMW (condensation product of a $C_{12}$-$C_{14}$-linear primary alcohol with 6 mol of ethylene oxide with narrow molecular weight distribution). This class of product likewise includes the Genapol™ grades from Clariant GmbH.

Moreover, other known grades of nonionic surfactants are also suitable, such as polyethylene, polypropylene, polybutylene and polypentylene oxide adducts of fatty alcohols having 8-22 carbon atoms and alkylphenols having 6 to 12 carbon atoms in the alkyl chain, addition products of ethylene oxide with a hydrophobic base, formed from the condensation of propylene oxide with propylene glycol or addition products of ethylene oxide with a reaction product of propylene oxide and ethylenediamine.

In addition, semipolar nonionic surfactants, for example amine oxides, can be used.

Suitable amine oxides are, in particular, $C_{10}$-$C_{18}$-alkyldimethylamine oxides and $C_8$-$C_{12}$-alkoxyethyldihydroxyethylamine oxides.

Suitable anionic surfactants are primarily straight-chain and branched alkylsulfates, -sulfonates, -carboxylates, -phosphates, alkyl ester sulfonates, arylalkylsulfonates, alkyl ether sulfates and mixtures of said compounds. Some of the suitable grades of anionic surfactants will be described below in more detail.

Alkyl Ester Sulfonates

Alkyl ester sulfonates are linear esters of $C_8$-$C_{20}$-carboxylic acids (i.e. fatty acids) which are sulfonated by $SO_3$, as described in "The Journal of the American Oil Chemists Society", 52 (1975), pp. 323-329. Suitable starting materials are natural fatty derivatives, such as, for example, tallow or palm oil fatty acid.

Alkylsulfates

Alkylsulfates are water-soluble salts or acids of the formula $ROSO_3M$, in which R is preferably a $C_{10}$-$C_{24}$-hydrocarbon radical, preferably an alkyl or hydroxyalkyl radical having 10 to 20 carbon atoms, particularly preferably a $C_{12}$-$C_{18}$-alkyl or hydroxyalkyl radical. M is hydrogen or a cation, e.g. an alkali metal cation (e.g. sodium, potassium, lithium) or ammonium or substituted ammonium, e.g. a methyl—, dimethyl— and trimethylammonium cation or a quaternary ammonium cation, such as tetramethylammonium and dimethylpiperidinium cation and quaternary ammonium cations derived from alkylamines such as ethylamine, diethylamine, triethylamine and mixtures thereof. Alkyl chains with $C_{12}$-$C_{16}$ are preferred here for low washing temperatures (e.g. below about 50° C.) and alkyl chains with $C_{16}$-$C_{18}$ are preferred for higher washing temperatures (e.g. above about 50° C.).

Alkyl Ether Sulfates

The alkyl ether sulfates are water-soluble salts or acids of the formula $RO(A)_mSO_3M$, in which R is an unsubstituted $C_{10}$-$C_{24}$-alkyl or hydroxyalkyl radical having 10 to 24 carbon atoms, preferably a $C_{12}$-$C_{20}$-alkyl or hydroxyalkyl radical, particularly preferably a $C_{12}$-$C_{18}$-alkyl or hydroxyalkyl radical. A is an ethoxy or propoxy unit, m is a number greater than 0, typically between about 0.5 and about 6, particularly preferably between about 0.5 and about 3 and M is a hydrogen atom or a cation, such as, for example, a metal cation (e.g. sodium, potassium, lithium, calcium, magnesium, etc.), ammonium or a substituted ammonium cation. Examples of substituted ammonium cations are methyl—, dimethyl—, trimethylammonium and quaternary ammonium cations, such as tetramethylammonium and dimethylpiperidinium cations, and also those derived from alkylamines, such as ethylamine, diethylamine, triethylamine, mixtures thereof and the like. Examples which may be mentioned are $C_{12}$-$C_{18}$-alkyl polyethoxylate (1.0) sulfate, $C_{12}$-$C_{18}$-alkyl polyethoxylate (2.25) sulfate, $C_{12}$-$C_{18}$-alkyl polyethoxylate (3.0) sulfate, $C_{12}$-$C_{18}$-alkyl polyethoxylate (4.0) sulfate, where the cation is sodium or potassium.

Other anionic surfactants which are useful for use in laundry detergents and cleaners are $C_8$-$C_{24}$-olefinsulfonates, sulfonated polycarboxylic acids prepared by sulfonation of the pyrolysis products of alkaline earth metal citrates, as described, for example, in British patent GB 1,082,179, alkylglyceryl sulfates, fatty acylglycerolsulfates, oleylglycerolsulfates, alkylphenolether sulfates, linear or branched alkylbenzenesulfonates, primary and secondary paraffinsulfonates, alkyl phosphates, alkyl ether phosphates, isethionates, such as acyl isethionates, N-acyltaurides, alkyl succinamates, sulfosuccinates, monoesters of sulfosuccinates (particularly saturated and unsaturated $C_{12}$-$C_{18}$-monoesters) and diesters of sulfosuccinates (particularly saturated and unsaturated $C_{12}$-$C_{18}$-diesters), acyl sarcosinates, sulfates of alkylpolysaccharides, such as sulfates of alkyl polyglycosides, branched primary alkyl sulfates and alkyl polyethoxycarboxylates, such as those of the formula $RO(CH_2CH_2)_k$ $CH^2COO^-M^+$ in which R is a $C_8$-$C_{22}$-alkyl, k is a number from 0 to 10 and M is a cation forming a soluble salt. Resin acids or hydrogenated resin acids, such as rosin or hydrogenated rosin or tall oil resins and tall oil resin acids can likewise be used. Further examples are described in "Surface Active Agents and Detergents" (Vol. I and II, Schwartz, Perry and Berch). A large number of such surfactants is also claimed in U.S. Pat. No. 3,929,678.

Examples of amphoteric surfactants which may be used in the formulations of the present invention are primarily those which have largely been described as derivatives of aliphatic secondary and tertiary amines in which the aliphatic radical may be linear or branched and in which one of the aliphatic substituents contains between 8 and 18 carbon atoms and contains an anionic, water-soluble group, such as, for example, carboxy, sulfonate, sulfate, phosphate or phosphonate.

Preferred amphoteric surfactants are monocarboxylates and dicarboxylates, such as cocoamphocarboxypropionate, cocoamidocarboxypropionic acid, cocoamphocarboxyglycinate (also referred to as cocoamphodiacetate) and cocoamphoacetate.

Further preferred amphoteric surfactants are alkyldimethylbetaines, alkylamidobetaines and alkyldipolyethoxybetaines with an alkyl radical which may be linear or branched, having 8 to 22 carbon atoms, preferably having 8 to 18 carbon atoms and particularly preferably having 12 to 18 carbon atoms. These compounds are marketed, for example, by Clariant GmbH under the trade name Genagen® CAB and LAB.

Typical examples of cationic surfactants are quarternary ammonium compounds, ester quats, ether quats, hydroxyethyl quats, ethoxylated quats, in particular quaternized fafty acid alkanolamine ester salts and dialkylaminopropylamine ester salts.

Suitable organic and inorganic builders are salts which are neutral or, in particular, alkaline and which are able to precipitate out calcium ions or to bind them in complexes. Suitable and in particular ecologically acceptable builder substances such as finely crystalline, synthetic water-containing zeolites of the type NaA which have a calcium-binding capacity in the range from 100 to 200 mg of CaO/g are preferably used. In addition to zeolite, preference is also given to using phyllosilicates and amorphous silicates. Also suitable are alkali metal phosphates which may be present in the form of their alkaline, neutral or acidic sodium or potassium salts. Examples thereof are trisodium phosphate, tetrasodium diphosphate, disodium dihydrogen diphosphate, pentasodium triphosphate, so called sodium hexametaphosphate, oligomeric trisodium phosphate with degrees of oligomerization of from 5 to 1000, in particular 5 to 50, and mixtures of sodium and potassium salts.

Organic builders which can be used are, for example, the carboxylic acids preferably used in the form of their sodium salts, such as citric acid, nitriloacetate (NTA) and ethylenediaminetetraacetic acid, provided such a use is not precluded for ecological reasons, and phosphonic and polyphosphonic acids. Analogously to this, it is also possible to use polymeric carboxylates and salts thereof. These include, for example, the salts of homopolymeric or copolymeric polyacrylates, polymethacrylates and in particular copolymers of acrylic acid with maleic acid, preferably those comprising 50% to 10% of maleic acid, and polyaspartic acid and also polyvinylpyrrolidone and urethanes. The relative molecular mass of the homopolymers is generally between 1000 and 100,000, that of the copolymers is between 2000 and 200,000, preferably 50,000 to 120,000, based on the free acid, particularly suitable are also water-soluble polyacrylates which are crosslinked, for example, with about 1% of a polyallyl ether of sucrose and which have a relative molecular mass above one million. Examples thereof are the polymers obtainable under the name Carbopol 940 and 941.

Suitable enzymes are those from the class of proteases, lipases, amylases, pullinases, cutinases and cellulases or mixtures thereof. Available proteases are BLAP®, Opticlean®, Maxacal®, Maxapem®, Esperase®, Savinase®, Purafect® OxP and/or Duraxym®, available amylases are Termamyl®, Amylase-LT®, Maxamyl®, Duramyl® and/or Purafect® OxAm, and available lipases are Lipolase®, Lipomax®, Lumafast® and/or Lipozym®.

The enzymes can be adsorbed to carrier substances and/or embedded in coating substances.

In addition to the cogranulates according to the invention, known conventional bleach activators can additionally be used. Suitable substances are those which carry O- and/or N-acyl groups and/or optionally benzoyl groups. Preference is given to polyacylated alkylenediamines, in particular N,N,N',N'-tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), carboxylic anhydrides, in particular phthalic anhydride, acylated polyhydric alcohols, in particular triacetin, ethylene glycol diacetate, 2,5-diacetoxy-2,5-dihydrofuran, enol esters, and acetylated sorbitol and mannitol, acylated sugar derivatives, in particular pentaacetylglucose (PAG), pentaacetylfructose, tetraacetylxylose and octaacetyllactose, and acetylated, optionally N-alkylated glucamine and gluconolactone, and/or N-acylated lactams, for example N-benzoylcaprolactam. Also suitable are glucose pentaacetate (GPA), xylose tetraacetate (TAX), nonanoyloxybenzenesulfonate (NOBS), sodium 4-benzoyloxybenzenesulfonate (SBOBS), sodium trimethylhexanoyloxybenzenesulfonate (STHOBS), tetraacetylcyanic acid (TACA), di-N-acetyldimethylglyoxine (ADMG) and 1-phenyl-3-acetylhydantoine (PAH), nonanoylcaprolactam phenylsulfonate ester (APES), nonanoylphenylsulphonate ester (NOPS), nitrilotriacetate (NTA), and quaternary ammonium nitrile compounds.

In addition to the bleach activators listed above, or else in place of them, the laundry detergent formulations may also comprise the sulfonimines and/or bleach-boosting transition metal salts or transition metal complexes known from EP 446 982 and EP 453 003 as so called bleach/catalysts.

The salts or extenders used are, for example, sodium sulfate, sodium carbonate or sodium silicate (waterglass).

Further constituents of the laundry detergent formulation may be optical brighteners, for example derivatives of diaminostilbenedisulfonic acid or alkali metal salts thereof and foam inhibitors, such as fatty acid alkyl ester alkoxylates, organopolysiloxanes and mixtures thereof with microfine, optionally silanized silica, and also paraffins, waxes, microcrystalline waxes and mixtures thereof with silanized silica. It is also advantageous to use mixtures of different foam inhibitors, e.g. those of silicone oil, paraffin oil or waxes. Preferably, foam inhibitors are bonded to a granular, water-soluble or —dispersible carrier substance. In order to bind traces of heavy metals, the salts of polyphosphonic acids, such as 1-hydroxyethane-1,1-diphosphonic acid (HEDP), ethylenediaminetetramethylenephosphonic acid (EDTMP) and diethylenetriaminepentamethylenephosphonic acid (DTPMP), can be added. Typical individual examples of further additives are sodium borate, cellulose and starch and ethers or esters thereof, sucrose, polydextrose and polymeric additives.

The examples below serve to illustrate the invention in more detail without limiting it thereto.

EXAMPLE 1

Preparation of TAED/CMC/N,N,N-trimethyl-(N-nitrilomethyl)ammonium methosulfate cogranulate 1st Pass:

18.6 kg of tetraacetylethylenediamine (TAED) and 1.4 kg of carboxymethylcellulose (CMC) were intensively mixed in a Lödige FKM 130 D plowshare mixer at a mixing speed of 135 rpm over a period of 5 min.

Then, in the same ploughshare mixer at a mixing speed of 135 rpm and connected rotating knifehead in the middle section of the mixer at a speed of 2800 rpm, an aqueous solution consisting of 2.0 kg of N,N,N-trimethyl-(N-nitrilomethyl)ammonium methosulfate, 0.5 kg of partially neutralized copolymer of acrylic acid and maleic acid, 2.4 kg of cumenesulfonate and 5.1 kg of water at a temperature of 75° C. was metered onto this powder premix over a period of 10 min directly at the knifehead and then the mixture was after-mixed for a further 2 min and granulated.

The moist granulate was then transferred to a fluidized-bed dryer and dried with gas-inlet temperatures of 100° C. to a residual water content of 2%.

This gave 6.9 kg of granulate with a particle size distribution of 500-1400 μm (yield: 27%), and 10.9 kg of fine fraction<500 μm and 7.6 kg of coarse fraction>1400 μm. The granulate with the particle size of 500-1400 μm has a bulk density of about 490 g/l.

$2^{nd}$ Pass:

The coarse fraction (7.6 kg greater than 1400 μm) from the $1^{st}$ pass was ground using a FitzMill and, together with the fine fraction (10.9 kg below 500 μm) from the $1^{st}$ pass and also 5.4 kg of fresh TAED/CMC (93:7) mixture, intensively mixed again in the plowshare mixer at a mixing speed of 135 rpm over a period of 5 min. Then, in the same plowshare mixer at a mixing speed of 135 rpm and connected rotating knifehead in the middle section of the mixer at a speed of 2800 rpm, an aqueous solution consisting of 2.0 kg of N,N,N-trimethyl-(N-nitrilomethyl)ammonium methosulfate, 0.5 kg of partially neutralized copolymer of acrylic acid and maleic acid, 2.4 kg of cumenesulfonate and 5.1 kg of water at a temperature of 75° C. was metered onto this powder premix over a period of 10 min directly at the knifehead, and then the mixture was after-mixed for a further 2 min and granulated.

The moist granulate was then transferred to a fluidized-bed dryer and dried with gas-inlet temperatures of 100° C. to a residual water content of 2%.

This gave 7.8 kg of granulate with a particle size distribution of 500-1400 μm and 12.9 kg of fine fraction<500 μm and 8.6 kg of coarse fraction>1400 μm. The granulate with the particle size of 500-1400 μm has a bulk density of about 495 g/l.

$3^{rd}$ Pass:

The coarse fraction (8.6 kg over 1400 μm) from the $2^{nd}$ pass was ground using a FitzMill and, together with the fine fraction (12.9 kg below 500 μm) from the $2^{nd}$ pass and also 5.4 kg of fresh TAED/CMC (93:7) mixture, intensively mixed again in a plowshare mixer with a mixing speed of 135 rpm over a period of 5 min. Then, in the same plowshare mixer at a mixing speed of 135 rpm and connected rotating knifehead in the middle section of the mixer at a speed of 2800 rpm, an aqueous solution consisting of 2.0 kg of N,N,N-trimethyl-(N-nitrilomethyl)ammonium methosulfate, 0.5 kg of partially neutralized copolymer of acrylic acid and maleic acid, 2.4 kg of cumenesulfonate and 5.1 kg of water at a temperature of 75° C. was metered onto this powder premix over a period of 10 min directly at the knifehead and then the mixture was after-mixed for a further 2 min and granulated.

The moist granulate was then transferred to a fluidized-bed dryer and dried with gas-inlet temperatures of 100° C. to a residual water content of 2%.

This gave 8.4 kg of granulate with a particle size distribution of 500-1400 μm, and 14.2 kg of fine fraction<500 μm and 9.7 kg of coarse fraction>1400 μm. The granulate with the particle size of 500-1400 μm has a bulk density of about 505 g/l.

$4^{th}$ Pass:

The coarse fraction (9.7 kg over 1400 μm) from the $3^{rd}$ pass was ground using a FitzMill and, together with the fine fraction (14.2 kg below 500 μm) from the $3^{rd}$ pass and also 5.4 kg of fresh TAED/CMC (93:7) mixture, intensively mixed again in the plowshare mixer at a mixing speed of 135 rpm over a period of 5 min. Then, in the same plowshare mixer at a mixing speed of 135 rpm and connected rotating knifehead in the middle section of the mixer at a speed of 2800 rpm, an aqueous solution consisting of 2.0 kg of N,N,N-trimethyl-(N-nitrilomethyl)ammonium methosulfate, 0.5 kg of partially neutralized copolymer of acrylic acid and maleic acid, 2.4 kg of cumenesulfonate and 5.1 kg of water at a temperature of 75° C. was metered onto this powder premix over a period of 10 min directly at the knifehead and then the mixture was after-mixed for a further 2 min and granulated.

The moist granulate was then transferred to a fluidized-bed dryer and dried with gas-inlet temperatures of 100° C. to a residual water content of 2%.

This gave 9.3 kg of granulate with a particle size distribution of 500-1400 μm and 14.9 kg of fine fraction<500 μm and 10.2 kg of coarse fraction>1400 μm. The granulate with the particle size of 500-1400 μm has a bulk density of about 510 g/l.

EXAMPLE 2

Preparation of CMC/N,N,N-trimethyl-(N-nitrilomethyl)ammonium methosulfate granulate In a Lödige FKM 130 D plowshare mixer, 18.6 kg of nitrile quat spray powder (consisting of 7.44 kg of N,N,N-trimethyl-(N-nitrilomethyl)ammonium methosulfate, 8.93 kg of cumenesulfonate, 1.86 kg of partially neutralized copolymer of acrylic acid and maleic acid and 0.37 kg of water) and 1.4 kg of carboxymethylcellulose (CMC) were intensively mixed at a mixing speed of 135 rpm over a period of 5 min.

Then, in the same plowshare mixer at a mixing speed of 135 rpm and connected rotating knifehead in the middle section of the mixer at a speed of 2800 rpm, 3.0 kg of water acidified with 1n $H_2SO_4$ to pH 3 was metered onto this powder premix over a period of 10 min directly at the knifehead, and then the mixture was after-mixed for a further 2 min and granulated.

The moist granulate was then transferred to a fluidized-bed dryer and dried with gas-inlet temperatures of 100° C. to a residual water content of 2%.

This gave 5.1 kg of granulate with a particle size distribution of 500-1400 μm and 11.0 kg of fine fraction<500 μm and 4.1 kg of coarse fraction>1400 μm. The granulate with the particle size of 500-1400 μm has a bulk density of about 550 g/l.

EXAMPLE 3

Preparation of TAED/CMC Granulate

In a Lödige FKM 130 D plowshare mixer, 18.6 kg of tetraacetylethylenediamine (TAED) and 1.55 kg of carboxymethylcellulose (CMC) were intensively mixed at a mixing speed of 135 rpm over a period of 5 min.

Then, in the same plowshare mixer at a mixing speed of 135 rpm and connected rotating knifehead in the middle section of the mixer at a speed of 2800 rpm, 3.5 kg of water were metered onto this powder premix over a period of 10 min directly at the knifehead, and then the mixture was after-mixed for a further 2 min and granulated.

The moist granulate was then transferred to a fluidized-bed dryer and dried with gas-inlet temperatures of 100° C. to a residual water content of 2%.

This gave 5.8 kg of granulate with a particle size distribution of 500-1400 μm and 11.8 kg of fine fraction<500 μm and 3.0 kg of coarse fraction>1400 μm. The granulate with the particle size of 500-1400 μm has a bulk density of about 470 g/l.

EXAMPLE 4

Storage Stability in Laundry Detergent Formulation

To test the storage stability of the activator granulates in a laundry detergent formulation, 0.7 g of TAED/nitrile quat/CMC cogranulate (according to Example 1, $1^{st}$ pass) or a mixture of 0.56 g of TAED/CMC granulate (according to Example 3) and 0.14 g of nitrile quat/CMC granulate (according to Example 2) were mixed with 7.5 g of standard detergent IEC-A, WfK Testgewebe GmbH, and 1.7 g of sodium percarbonate, and the resulting mixtures were placed in Petri dishes with a diameter of 90 mm. A Petri dish with the above-described initial weight was prepared for each active content determination planned in the course of storage. The Petri dishes filled as described above were then stored open in a climatically controlled cabinet at a temperature of 38° C. and a relative atmospheric humidity of 80% for 5 days. After a storage time of 1, 2 and 5 days, the residual content of activator was determined by means of iodometric titration and calculated as a percentage of the initial content used.

| Storage Time, Days | TAED/Nitrile | TAED/CMC + Nitrile quat/CMC |
|---|---|---|
| 0 | 100% | 100% |
| 1 | 89% | 81% |
| 2 | 78% | 66% |
| 5 | 46% | 32% |

It is found that the TAED/nitrile quat/CMC cogranulate according to the invention has better storage stability than a mixture of TAED/CMC granulate and nitdle quat/CMC granulate with a similar overall composition.

EXAMPLE 5

Water Absorption During Open Climatically-Controlled Storage

To test the water absorption of the activator granulates, 4.0 g of TAED/nitrile quat/CMC cogranulate (according to Example 1, $1^{st}$ pass) or a mixture of 3.2 g of TAED/CMC granulate (according to Example 3) and 0.8 g of nitrile quat/CMC granulate (according to Example 2) were placed in Petri dishes with a diamenter of 90 mm and then stored open in a climatically-controlled cabinet at a temperature of 38° C. and a relative atmospheric humidity of 80%. After a storage time of 1 day, the weight increase as a result of the absorbed water was ascertained by weighing and expressed as a percentage based on the initial weight.

| Storage Time, Days | TAED/Nitrile quat/CMC | TAED/CMC + Nitrile quat/CMC |
|---|---|---|
| 0 | 0% | 0% |
| 1 | 16% | 21% |

It is found that the TAED/nitrile quat/CMC cogranulate according to the invention absorbs less water in the same storage period than a mixture of TAED/CMC granulate and nitrile quat/CMC granulate with a similar overall composition.

EXAMPLE 6

Washing Performance of Stored Laundry Detergent Formulations

To test the washing performance of stored laundry detergent formulations in a LINITEST laboratory washing machine, 0.1 g of TAED/nitrile quat/CMC cogranulate (according to Example 1, $4^{th}$ pass) or a mixture of 0.06 g of TAED/CMC granulate (according to Example 3) and 0.04 g of nitrile quat/CMC granulate (according to Example 2) were mixed with 1.0 g of standard laundry detergent IEC-A, WfK Testgewebe GmbH, and 0.15 g of sodium perborate monohydrate, the resulting mixtures were placed in Petri dishes with a diameter of 90 mm and then stored over a storage time of 1 day open in a climatically-controlled cabinet at a temperature of 38° C. and a relative atmospheric humidity of 80%. The stored detergent formulations were then introduced completely into beakers, filled with 200 ml of water (15° German hardness, Ca:Mg=3:2), in the LINITEST laboratory washing machine, test fabric (CFT BC-1, WfK Testgewebe GmbH) and steel spheres (to increase the washing mechanics) were added and, after the beakers had been sealed, washing experiments were carried out at 20° C. and 40° C. The washing time was 30 min. As a measure of the washing performance, an Elrepho 3000 from Datacolor was used to determine the reflectance difference in the test fabric against a test fabric washed only with 1.0 g of standard detergent IEC-A and 0.15 g of sodium perborate monohydrate, and the following values were obtained:

| Temperature [° C.] | Reflectance difference against TAED/nitrile quat/CMC | IEC-A/sodium perborate monohydrate TAED/CMC + Nitrile quat/CMC |
|---|---|---|
| 20 | 4.1 | 3.2 |
| 40 | 6.0 | 5.4 |

It is found that the TAED/nitrile quat/CMC cogranulate according to the invention, following storage in a laundry detergent formulation, achieves a better bleaching performance at 20° C. and 40° C. than a mixture of TAED/CMC granulate and nitrile quat/CMC granulate with a similar overall composition stored in a laundry detergent formulation over the same period.

The invention claimed is:

1. A process for preparing a bleach activator cogranulate, said process comprising:

a) spraying an aqueous solution consisting of one or more ammonium nitrile compounds and water onto a solid particle consisting of a further bleach activator other than an ammonium nitrile to moisten the solid particle to provide a moist solid particle;

wherein an acidic additive, a binder, or mixtures thereof are optionally added to the aqueous solution and/or further bleach activator, said acidic additive selected from the group consisting of an acidic component, a salt thereof or an acidic polymer further selected from the group consisting of sulfuric acid, sodium hydrogen sulfate, phosphoric acid, sodium hydrogen phosphate, phosphonic acid, polyphosphonic acid, glycolic acid, succinic acid, succinic anhydride, glutaric acid, glutaric anhydride, adipic acid, adipic anhydride, maleic acid, maleic anhydride, lactic acid, and mixtures thereof; and said binder selected from the group consisting of cellulose, an ether or ester of starch, a film-forming polymer, an alkane sulfonate, an arylsulfonate, an alkylarylsulfonate, an alkyl ether sulfate, an alkylsulfate, an alpha-olefinsulfonate, a soap, and mixtures thereof;

b) granulating the moist solid particle to provide a moist granulate; and c) drying and sieving the moist granulate to provide the bleach activator cogranulate.

2. The process of claim 1, wherein the ammonium nitrile is a compound of the formula (1)

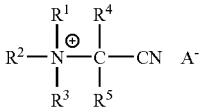

(1)

in which $R^1$, $R^2$, $R^3$ are identical or different, and are linear or branched $C_1$-$C_{24}$-alkyl groups, $C_2$-$C_{24}$-alkenyl groups or are $C_1$-$C_4$-alkoxy-$_1$-$C_4$-alkyl groups, substituted or unsubstituted benzyl, or in which $R^1$ and $R^2$ together with the nitrogen atom to which they are bonded form a ring having 4 to 6 carbon atoms which may be substituted by $C_1$-$C_5$-alkyl, $C_1$-$C_5$-alkoxy, $C_1$- to $C_5$-alkanoyl, phenyl, amino, ammonium, cyano, cyanamino, chlorine or bromine, and, in addition to the nitrogen atom, can contain one or two oxygen or nitrogen atoms, a group N—$R^6$ or a group $R^3$—N—$R^6$ in place of carbon atoms, in which $R^6$ is hydrogen, $C_1$- to $C_5$-alkyl, $C_2$- to $C_5$-alkenyl, $C_2$- to $C_5$-alkynyl, phenyl, $C_7$- to $C_9$-aralkyl, $C_5$- to $C_7$cycloalkyl, $C_1$- to $C_6$-alkanoyl, cyanomethyl or cyano, $R^4$ and $R^5$ are hydrogen, $C_1$-$C_4$-alkyl, $C_1$-$C_4$-alkenyl, $C_1$-$C_4$-alkoxy-$C_1$-$C_4$-alkyl, phenyl or $C_1$-$C_3$-alkylphenyl and A is an anion, selected from the group consisting of chloride, bromide, iodide, fluoride, sulfate, hydrogensulfate, carbonate, hydrogencarbonate, phosphate, mono- and dihydrogenphosphate, pyrophosphate, metaphosphates, nitrate, methylsulfate, phosphonate, methylphosphonate, methanedisulfonate, methylsulfonate, and ethanesulfonate or A is an anion of the formulae $R^7SO_3^{\ominus}$, $R^7SO_4^{\ominus}$ or $R^7COO^{\ominus}$, in which $R^7$ is $C_1$-$C_{20}$-alkyl or $C_1$-$C_{18}$-alkylphenyl.

3. The process of claim 1, wherein the ammonium nitrile, a compound of the formula (2)

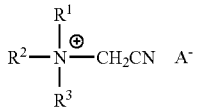

(2)

where $R^1$, $R^2$ and $R^3$ are a linear or branched saturated or unsaturated alkyl group having 1 to 24 carbon atoms, an alkenyl group having 2 to 24 carbon atoms or substituted or unsubstituted benzyl, and A is any charge-balancing ion selected from the group consisting of chloride, bromide, iodide, fluoride, sulfate, hydrogensulfate, carbonate, hydrogencarbonate, phosphate, mono- and dihydrogenphosphate, pyrophosphate, metaphosphate, nitrate, methylsulfate, phosphonate, methylphosphonate, methanedisulfonate, methylsulfonate, and ethanesulfonate or A is an anion of the formulae $R^7SO_3^{\ominus}$, $R^7SO_4^{\ominus}$ or $R^7COO^{\ominus}$, where $R^7$ is $C_1$-$C_{20}$-alkyl, or $C_1$-$C_{18}$-alkylphenyl.

4. The process of claim 1, wherein the further bleach activator is selected from the group consisting of, N,N,N',N'-tetraacetylethylenediamine (TAED), nonanoylcaprolactam phenylsulfonate ester (APES), glucose pentaacetate (GPA), xylose tetraacetate (TAX), acyloxybenzenesulfonates, and diacetyldioxohexahydrotriazine (DADHT), tetraacetylglucoluril (TAGU), tetraacetylcyanic acid (TACA), di-N-acetyldimethylglyoxine (ADMG), and 1-phenyl-3-acetylhydantoin (PAH).

5. The process of claim 1, wherein one or more binders are present to provide the bleach activator cogranulate with from 1 to 45 weight percent of said binders, based on said cogranulate.

6. The process of claim 1, wherein one or more acidic additives are present to provide the bleach activator cogranulate with from 0 to 20 weight percent of said acidic additives, based on said cogranulate.

7. The process of claim 1, wherein the ammonium nitrile compound and further bleach activator are present in an amount from 50 to 99% by weight based on said cogranulate.

8. The process of claim 1, wherein the ammonium nitrile compound and further bleach activator are present in an amount from 70 to 98% by weight based on said cogranulate.

9. The process of claim 1, wherein the ammonium nitrile compound and further bleach activator are present in an amount from 80 to 96% by weight, based on said cogranulate.

10. The process of claim 1, further comprising coating said cogranulate with 0 to 30% by weight of a film-forming substance.

11. The process of claim 1, further comprising compressing said cogranulates to provide a large agglomerate and comminuting said large agglomerate to increase the bulk density of said cogranulate.

12. The process of claim 3, wherein $R^4$ and $R^5$ are selected from the group consisting of hydrogen, methyl or phenyl and when $R^4$ is hydrogen, $R^5$ is not hydrogen.

13. The process of claim 3, wherein A is an anion of the formulae $R^7SO_3^{\ominus}$, $R^7SO_4^{\ominus}$or $R^7COO^{\ominus}$, in which $R^7$ is $C_{10}$-$C_{18}$-alkyl.

14. The process of claim 1, further comprising compressing the bleach activator cogranulate to provide a large agglomerate and comminuting the large agglomerate.

* * * * *